US006584947B2

(12) United States Patent
Kampichler et al.

(10) Patent No.: US 6,584,947 B2
(45) Date of Patent: Jul. 1, 2003

(54) CYLINDER HEAD GASKET

(75) Inventors: Gunter Kampichler, Rubstorf (DE); Stefan Jager, Lenting (DE)

(73) Assignee: Motorenfabrik Hatz GmbH & Co. KG, Ruhstorf (DE)

( * ) Notice: Subject to any disclaimer, the term of this patent is extended or adjusted under 35 U.S.C. 154(b) by 0 days.

(21) Appl. No.: 10/089,582

(22) PCT Filed: Jul. 25, 2001

(86) PCT No.: PCT/EP01/08590

§ 371 (c)(1),
(2), (4) Date: Mar. 28, 2002

(87) PCT Pub. No.: WO02/10572

PCT Pub. Date: Feb. 7, 2002

(65) Prior Publication Data

US 2002/0148429 A1 Oct. 17, 2002

(30) Foreign Application Priority Data

Aug. 2, 2000 (DE) ..... 100 37 748

(51) Int. Cl.[7] ..... F02F 1/00
(52) U.S. Cl. ..... 123/193.1; 123/193.5

(58) Field of Search ..... 123/193.1, 193.3, 123/193.5, 184.21

(56) References Cited

U.S. PATENT DOCUMENTS

| | | | | |
|---|---|---|---|---|
| 3,853,099 A | * | 12/1974 | Feather et al. | 123/193.5 |
| 4,108,135 A | | 8/1978 | Kubis | |
| 4,280,456 A | | 7/1981 | Klomp | |
| 5,414,993 A | * | 5/1995 | Kon | 123/193.5 |
| 5,575,245 A | | 11/1996 | Watanabe | |
| 5,577,472 A | * | 11/1996 | Banta, III et al. | 123/193.3 |
| 5,970,941 A | * | 10/1999 | Bock | 123/193.3 |

FOREIGN PATENT DOCUMENTS

| | | |
|---|---|---|
| DE | 196 52 049 | 7/1998 |

* cited by examiner

*Primary Examiner*—Marguerite McMahon
(74) *Attorney, Agent, or Firm*—Katten Muchin Zavis Rosenman

(57) ABSTRACT

In a one-cylinder or multi-cylinder internal combustion engine there is provided in the cylinder cover (7) a drainage duct (12, 14), which at one end opens radially inward of the annular gasket in the region of the inner rim of the cylinder liner (2), and whose outer end is in communication with the intake port (13) or exhaust port (15) in the cylinder cover (7).

13 Claims, 2 Drawing Sheets

CYLINDER HEAD GASKET

Figure 1:
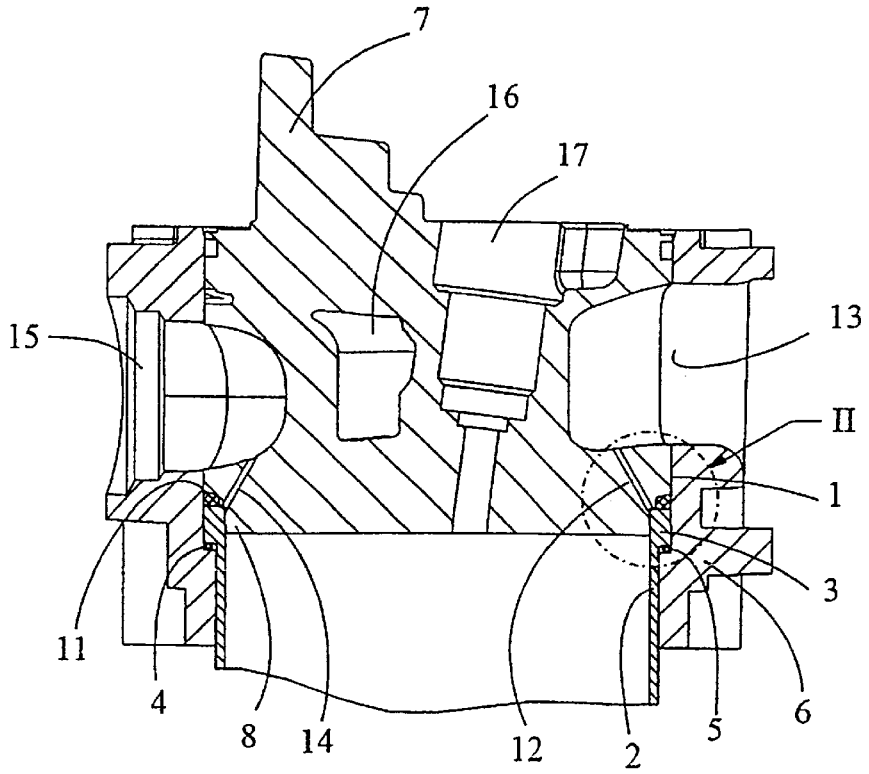

The invention relates to a cylinder cover gasket for a one-cylinder or multi-cylinder internal combustion engine, especially a four-cycle diesel engine, wherein there is allocated to each cylinder a separate cylinder cover which is placed sealingly on a cylinder liner which lines the cylindrical bore of the crankcase, the liner being terminated at the cylinder cover with a liner flange seated on a corresponding shoulder of the cylindrical bore, and an annular gasket being provided between the end annular face of the cylinder liner and the adjoining cylinder cover.

A multi-cylinder four-cycle diesel engine with separate cylinder covers is described in German Patent 19652049. Therein the cylindrical receiving bores in the crankcase are lined by liners, which at the cover end are provided with a liner flange. This liner flange is seated on a shoulder of the cylindrical bore. The cylinder cover is clamped vertically against the end annular face of the cylinder liner, a metal annular gasket being provided between the cylinder cover and cylinder liner in order to impart watertightness and gastightness, and two jointed gasket rings, which are rotated relative to one another, being inlaid as additional sealing against combustion gas, the inner of the said rings adjoining the combustion chamber.

In the known engine construction, sealing of the cylinder cover and liner from the cylindrical bore is problematic. In water-cooled engines in particular, a water path that exists on the one hand between the circumferential face of the cylinder cover and the cylindrical bore in the crankcase can encounter an oil path that exists on the other hand between the circumferential face of the liner flange of the liner and the cylindrical bore, at least if the liner is supported floatingly. Moreover, it can be anticipated that, as a result of the pulsations in the combustion chamber, hot combustion gases will arrive at the annular gasket, where the danger exists that there they will enter the cooling water and penetrate into the oil spaces of the engine. Another danger, depending on the configuration of the annular gasket, is that this gasket can be prematurely destroyed by the action of the hot combustion gases.

In contrast, the object of the present invention is to provide a particularly secure and durable annular gasket between cylinder cover and liner flange of the cylinder liner, in order to ensure that water paths on the one hand and oil paths on the other hand are sealed from one another, and that mixing of combustion gases into these paths is reliably prevented. An additional object to be achieved is that a suitable annular gasket does not necessitate any particularly high axial clamping pressure, so that undesired stresses between the components adjoining the annular gasket are avoided.

This object is achieved according to the invention in a cylinder cover gasket of the type mentioned in the introduction by the fact that there is provided in the cylinder cover a drainage duct, which at one end opens radially inward of the annular gasket in the region of the inner rim of the cylinder liner, and whose outer end is in communication with the intake port or exhaust port in the cylinder cover.

For this purpose each cylinder is preferably provided with two drainage ducts, one of which opens into the intake port and the other into the exhaust port.

By virtue of the drainage ducts, gas leaks caused by combustion-gas pulsations flow away via short paths into the inlet or exhaust port, before they arrive at the annular gasket and before harmful gas pressures can build up there. Thus the drainage ducts act to provide direct pressure relief in the region of the annular gap sealed by the annular gasket. As a result of the direct removal of gas leaks through the drainage bores, reliable gastightness relative to the water and oil spaces of the engine is achieved.

The use of the present invention is not limited to water-cooled engines: to the contrary, it is also practical in air-cooled engines, although less stringent requirements are imposed on the type of annular gasket in such cases. In contrast to standard engine constructions with a large-area cylinder-head gasket, which covers a plurality of cylindrical bores, there is provided according to the invention a separate annular gasket for each cylindrical bore with associated cylinder cover.

Within the context of a particularly advantageous embodiment of the invention, it is provided that the cylinder cover is terminated at its inner end with a neck-shaped projection, which is formed by a turned-down portion and which engages with light press fit in the associated inner space of the cylinder liner. Depending on cylinder diameter, a relatively short neck-shaped projection with a height of about 4 to 6 mm is generally sufficient for this purpose. An interference fit corresponding approximately to H6 m6 at the circumference of the cylinder cover is suitable as the light press fit. By the fact that such a press fit represents an effective radial seal, annular gaskets maintained under high axial clamping pressures can be largely avoided. Instead, it is sufficient merely to dimension the axial forces exerted via the cylinder-head studs such that they are just larger than the forces occurring due to internal combustion.

In order to ensure that combustion gases are removed as rapidly as possible via the drainage ducts, it is provided according to a further inventive embodiment that the inner end of the respective drainage duct opens into an annular space adjoining the associated inner circumferential edge of the cylinder liner.

This annular space then can be formed by an axial separation between cylinder cover and cylinder liner and/or by a chamfer, groove or step provided on these components and adjoining the inner circumferential edge of the cylinder liner. These measures ensure immediate pressure equalization in the event of gas leaks, and so harmful pressure fluctuations do not occur at the annular gasket, nor do high temperatures, which in water-cooled engines are lower than 130° C.

In water-cooled engines in particular, it is advisable for the annular gasket be formed by an O-ring, which is received in an annular groove defined by cylinder cover, cylinder liner and cylindrical bore in such a way that it is pressed on all sides inside the annular groove.

This annular groove is formed by a turned recess in the cylinder cover and/or in the region of the outer circumferential edge of the cylinder liner. Conical turned recesses can also be used for this purpose, preferably when one such is formed on the cylinder cover and another is formed on the cylinder liner, so that, when these components are brought together, an O-ring introduced between the turned recesses is pressed strongly against the cylindrical bore, where it forms an effective barrier between the water and oil paths at the inner circumference of the cylindrical bore.

In air-cooled engines, in contrast, there is no need for such an O-ring; here the radial seal established between the neck-shaped projection of the cylinder cover and the inner circumference of the cylinder liner is sufficient in combination with one or more drainage ducts.

Besides such a radial seal, it is possible according to the invention to establish an additional axial seal by providing that the cylinder liner and cylinder cover directly adjoin one another in axial direction at a position radially inward of the annular groove for the O-ring, such that there is formed an annular sealing and support face subjected to the contact-area clamping effect due to the cylinder-head studs. Thereby there is produced an axial annular sealing face that in one practical embodiment has a radial width of about 1 mm.

A particularly long service life of the O-ring can be achieved by making it a part of a combined cylinder cover gasket, specifically by the fact that, at a position radially inward of the annular groove, the cylinder liner and cylinder cover are braced against one another in axial direction via a metal gasket ring, which is subjected to the contact-area clamping effect of the cylinder-head studs. Compared with the O-ring, a perfect gas barrier can be achieved by such a gasket ring, which preferably is made of copper.

Such a metal gasket ring also has the advantage that the axial separation between cylinder cover and cylinder liner is formed by the gasket ring, which constitutes the radially outer boundary of the annular space into which the inner end of the drainage duct opens. In this case there is no need to form grooves or chamfers on the adjoining components to create such an annular space.

Because of the plastic deformability of such a copper gasket ring, the positioning of the cylinder cover relative to the cylinder liner can be adapted to a limited extent, and so the combustion chamber can be adjusted to the correct orientation and thus a specified compression ratio can be ensured. A comparable effect can be achieved by inserting a deformable metal compensating ring of limited axial extent between the liner flange and the shoulder of the cylindrical bore functioning as support for the said flange. Hollow rings or channel-section rings whose opening is directed toward the center, in both cases of steel, aluminum or brass, are preferred for this purpose. These compensating rings do not have any kind of sealing function, but are used merely as deformable yielding components in order to ensure that the criteria of combustion-chamber gap size are satisfied.

According to a further embodiment of the invention, it is provided that the cylinder cover is made of an aluminum alloy and the cylinder liner is made of gray cast iron by the centrifugal casting method. These materials ensure that the gastightness becomes considerably better with increasing operating temperature, because of the fact that the thermal expansion of the cylinder cover is greater than that of the cylinder liner, resulting in an increasing clamping effect between these components during operation. Some gas leaks have to be tolerated only during a cold start of the engine, but usually they are not a concern, since they reach only fractions of a normal blow-by value at the piston rings.

In air-cooled engines, which can operate without O-rings as the annular gasket between cylinder cover and cylinder liner, it may be advisable to dispose at least one metal gasket ring adjoining the combustion chamber inside a shallow turned recess on the inside of the cylinder liner, to bridge the joint between cylinder cover and cylinder liner. Such metal gasket rings can be formed as split sheet-metal packing rings of V2A steel with a wall thickness of 0.2 to 0.3 mm, similar to piston rings, and two of such gasket rings with joints offset in circumferential direction can be provided. Another suitable alternative is gasket rings in the form of non-split, precisely sized steel packing rings, with correspondingly smaller wall thickness, so that they are pressed sealingly into the corresponding turned recess of the cylinder liner and of the cylinder cover respectively by the compression and ignition pressure.

Figure 2:
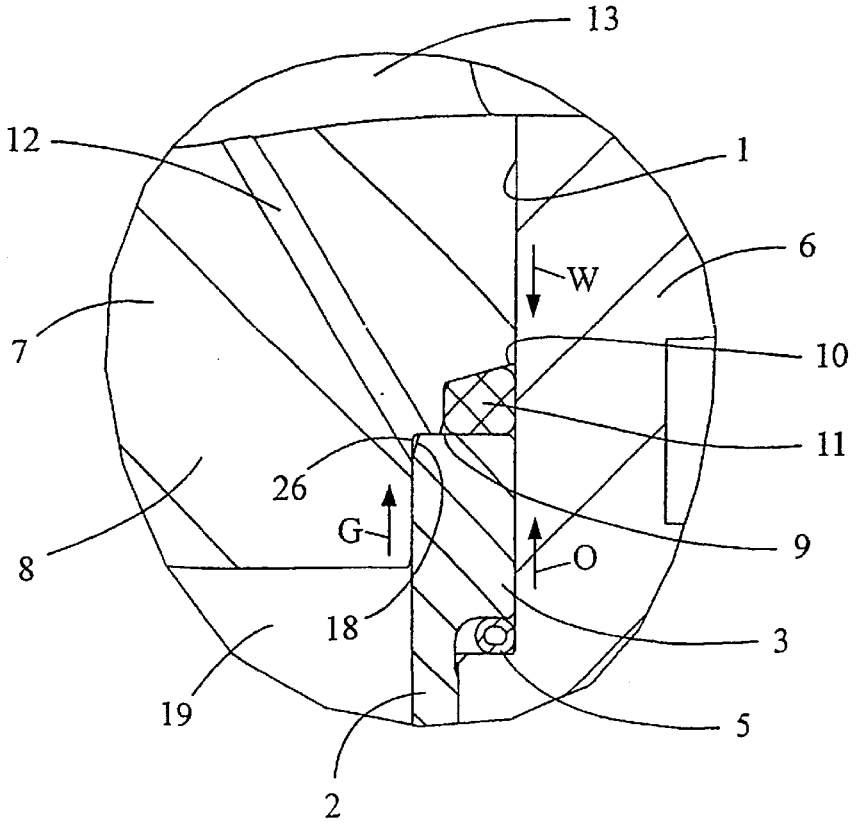

The invention will be explained hereinafter by means of several alternative embodiments, wherein FIG. 1 shows a cross section through the upper end of a cylinder and through the cylinder cover, FIG. 2 shows an enlarged detail according to II of FIG. 1, and FIGS. 3 to 6 each show a detail according to FIG. 2 with four different versions thereof.

FIG. 1 shows, inside a cylindrical bore 1 in crankcase 6, the upper end of a cylinder liner 2, which is terminated by a widened liner flange 3. This engages from behind with a shoulder 4 of cylindrical bore 1. Between shoulder 4 and liner flange 3 there is inserted a compensating ring 5, which is formed by a hollow brass ring (FIG. 2).

A cylinder cover 7 made of an aluminum alloy is inserted with a light H6/m6 press fit according to DIN 7157 in cylindrical bore 1. As the connecting piece it has a short neck-shaped projection 8, with which it engages in the interior of cylinder liner 2. Between an end annular face 9 (FIG. 2) of liner shoulder 3 and cylinder cover 7 there is disposed in an annular groove 9 of the cylinder cover an O-ring 11. This is pressed into annular groove 9 in such a way that it bears on all sides against its walls formed by cylinder cover 7, cylinder liner 2 and cylindrical bore 1. Through cylinder cover 7 there is bored a drainage duct 12, which opens at one end into the region of the inner rim of cylinder liner 2 and at the other end into intake port 13 in the interior of cylinder cover 7. In contrast, the opposite drainage duct 14 opens into exhaust port 15.

Furthermore, FIG. 1 shows, in the region of cylinder cover 7, a cross section through a cooling-water duct 16 as well as receiving bore 17 for a pump nozzle or a nozzle-holder combination.

FIG. 2 shows a chamfer 18 in the region of the end inside edge of cylinder liner 2. Chamfer 18 forms an annular space 26, in which gas leaks are trapped and removed via drainage duct 12, these gas leaks being combustion gases which, under the impetus of exhaust-gas pulsations, arrive from combustion chamber 19 by traveling upward according to arrow G through the annular gap between neck-shaped projection 8 and the inside wall of cylinder liner 2, where the rim end of the said liner adjoins the circumference of the said projection. Because of O-ring 11, an oil path directed according to arrow O at the outer circumference of liner shoulder 3 is securely sealed off from a water path leading downward according to arrow W in the circumferential gap between cylinder cover 7 and cylindrical bore 1. By the fact that the hot combustion gases according to arrow G are trapped immediately in annular space 26 and removed via drainage duct 12, O-ring 11 is protected from thermal stresses, whereby its service life is correspondingly prolonged. Harmful ingress of gas into the cooling water or into the oil circulation is also prevented. The oil path according to arrow O is fed by the oil circulation, by means of which cylinder liner 2 is supported floatingly with its outer circumference inside the lower part of cylindrical bore 1. Since compensating ring 5 does not have any increased sealing effect, oil from the lubricating-oil circulation travels past compensating ring 5 between the outer circumference of liner flange 3 and cylindrical bore 1.

Figure 3:
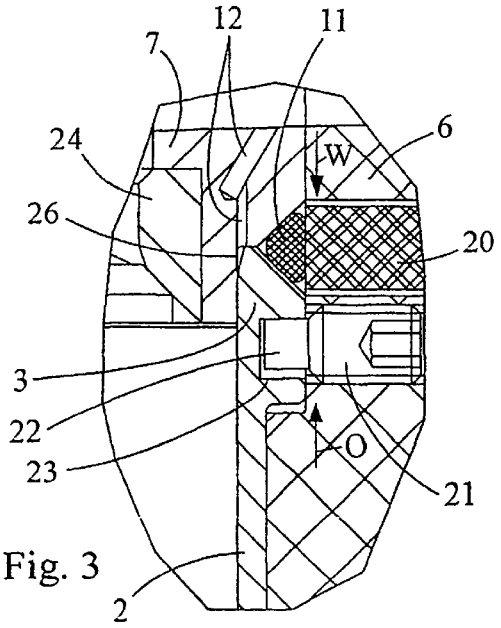

In the version according to FIG. 3, O-ring 11 is pressed into a triangular shape between corresponding inclined turned recesses of cylinder cover 7 on the one hand and liner flange 3 on the other hand. In a groove open toward the joint plane of crankcase 6, there is received a round-cord gasket 20, which seals the water path according to arrow W and the oil path according to arrow O in the region of the joint, which is illustrated by a hatched checkerboard pattern. Cylinder liner 2 is secured against twisting by a headless screw 21, which engages with a precisely sized inner end 22 in a corresponding hole 23 of liner shoulder 3. At the left, a valve-seat ring (24) is visible in section adjacent to drainage duct 12.

Figure 4:
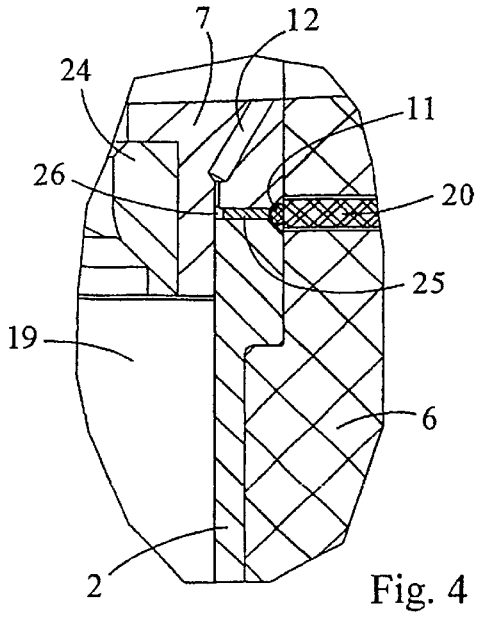
Figure 6:
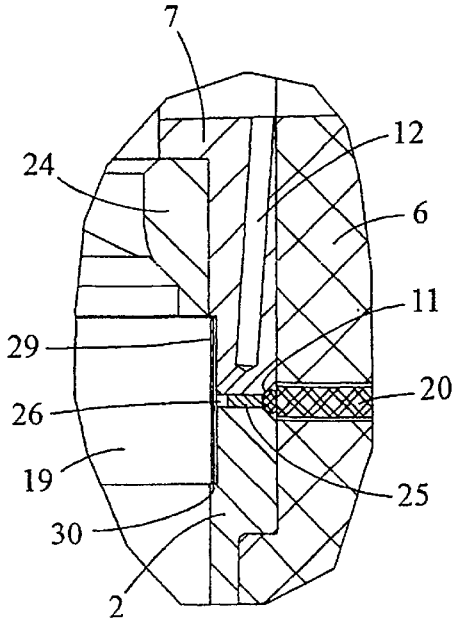
Figure 5:
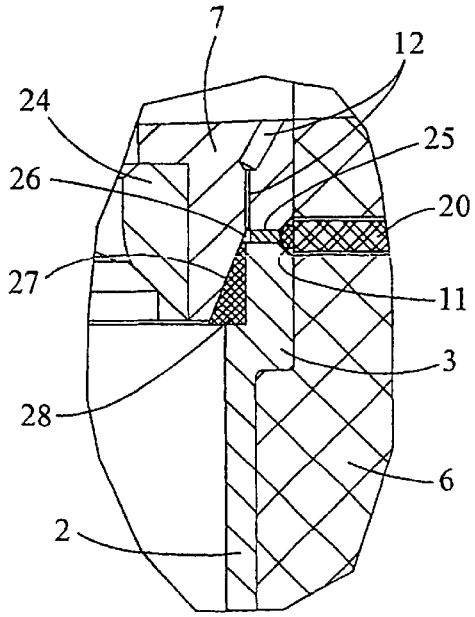

The versions according to FIGS. 4 to 6 each show an annular gasket, which is designed as an O-ring 11 and which, as in all other versions, is combined with a round-cord gasket 20. These figures also show a metal gasket ring 25 as the axial seal between cylinder cover 7 and cylinder liner 2. Metal gasket ring 25 is preferably made of a deformable metal such as copper, so that it conforms particularly well to the adjoining sealing faces and also allows a limited degree of axial adjustment between cylinder cover 7 and cylinder liner 2 for the purpose of satisfying the criteria of combustion-chamber gap size.

According to FIG. 5, cylinder cover 2 is provided, underneath an annular space 26, which is formed between gasket ring 25, cylinder cover 7 and cylinder liner 2, and into which drainage duct 12 opens, with a chamfer 27, which together with cylinder liner 2 forms a circumferential cavity of triangular cross section, packed gastightly with a compacted metal braid 28 or a fitted shaped ring, for example of copper. This compaction is achieved by appropriately compressing, during introduction of cylinder cover 7 into the cylindrical bore, a ring of metal braid, whose annular cross section in the uncompacted condition is rectangular.

In the version according to FIG. 6, there is disposed, inside a turned recess 30 on the inside of cylinder liner 2, a metal gasket ring 29 which adjoins combustion chamber 19 and which bridges the joint between cylinder cover 7 and cylinder liner 2. Gasket ring 29 comprises either a precisely sized V2A steel ring or is composed of at least two open thin-walled steel rings, which are disposed with their joints offset in circumferential direction.

What is claimed is:

1. A cylinder cover gasket for a one-cylinder or multi-cylinder internal combustion engine, especially a four-cycle diesel engine, wherein there is allocated to each cylinder a separate cylinder cover (7) which is placed sealingly on a cylinder liner (2) which lines the cylindrical bore (1) of the crankcase (6), the liner being terminated at the cylinder cover (7) with a liner flange (3) seated on a corresponding shoulder (4) of the cylindrical bore (1), and an annular gasket being provided between the end annular face (9) of the cylinder liner (2) and the adjoining cylinder cover (7), characterized in that there is provided in the cylinder cover (7) a drainage duct (12, 14), which at one end opens radially inward of the annular gasket in the region of the inner rim of the cylinder liner (2), and whose outer end is in communication with the intake port (13) or exhaust port (15) in the cylinder cover (7).

2. A cylinder cover gasket according to claim 1, characterized in that each cylinder is provided with two drainage ducts (12, 14), one of which opens into the intake port (13) and the other into the exhaust port (15).

3. A cylinder cover gasket according to claim 1, characterized in that the cylinder cover (7) is terminated at its inner end with a neck-shaped projection (8), which is formed by a turned-down portion and which engages with light press fit in the associated inner rim of the cylinder liner (2).

4. A cylinder cover gasket according to claim 1, characterized in that the inner end of the drainage duct (12, 14) opens into an annular space (26) adjoining the associated inner circumferential edge of the cylinder liner (2).

5. A cylinder cover gasket according to claim 4, characterized in that the annular space (26) is formed by an axial separation between cylinder cover (7) and cylinder liner (2) and/or by a chamfer, groove or step provided on these components and adjoining the inner circumferential edge of the cylinder liner (2).

6. A cylinder cover gasket according to claim 1, characterized in that the annular gasket is formed by an O-ring (11), which is received in an annular groove (9) defined by cylinder cover (7), cylinder liner (2) and cylindrical bore (1) in such a way that it is pressed on all sides inside the annular groove (9).

7. A cylinder cover gasket according to claim 1, characterized in that the annular groove (9) is formed by a turned recess in the cylinder cover (7) and/or in the region of the outer circumferential edge of the cylinder liner (2).

8. A cylinder cover gasket according to claim 7, characterized in that the cylinder liner (2) and cylinder cover (7) directly adjoin one another in axial direction at a position radially inward of the annular groove (9), such that there is formed an annular sealing and support face subjected to the contact-area clamping effect due to the cylinder-head studs.

9. A cylinder cover gasket according to claim 7, characterized in that, at a position radially inward of the annular groove (9), the cylinder liner (2) and cylinder cover (7) are braced against one another in axial direction via a metal gasket ring (25), which is subjected to the contact-area clamping effect of the cylinder-head studs.

10. A cylinder cover gasket according to claim 5, characterized in that the axial separation between cylinder cover (7) and cylinder liner (2) is formed by the gasket ring (25), which constitutes the radially outer boundary of the annular space (26) into which the inner end of the drainage duct (12, 14) opens.

11. A cylinder cover gasket according to claim 1, characterized in that a deformable metal compensating ring (5) of limited axial extent is inserted between the liner flange (3) and the shoulder (4) of the cylindrical bore (1) functioning as support for the said flange.

12. A cylinder cover gasket according to claim 1, characterized in that the cylinder cover (7) is made of an aluminum alloy and the cylinder liner (2) is made of gray cast iron by the centrifugal casting method.

13. A cylinder cover gasket according to claim 1, characterized in that at least one metal gasket ring (29) adjoining the combustion chamber (19) is disposed inside a shallow turned recess (30) on the inside of the cylinder liner (2) and of the cylinder cover (7), to bridge the joint between cylinder cover (7) and cylinder liner (2).

* * * * *